United States Patent [19]

Levine

[11] Patent Number: 4,536,914

[45] Date of Patent: Aug. 27, 1985

[54] WET-DRY VACUUM CLEANER

[75] Inventor: Morris M. Levine, Scarsdale, N.Y.

[73] Assignee: CIC Int'l Corp., New York, N.Y.

[21] Appl. No.: 587,227

[22] Filed: Mar. 7, 1984

[51] Int. Cl.[3] ..... A47L 5/24
[52] U.S. Cl. ..... 15/344; 15/353
[58] Field of Search ..... 15/320, 321, 344, 347, 15/353

[56] References Cited

U.S. PATENT DOCUMENTS

| | | | |
|---|---|---|---|
| 3,018,504 | 1/1962 | Hart | 15/353 X |
| 3,079,626 | 3/1963 | Yonkers et al. | 15/353 X |
| 3,605,786 | 9/1971 | Machin | 15/353 X |
| 3,939,527 | 2/1976 | Jones | 15/353 |
| 4,142,270 | 3/1979 | Nauta | 15/353 |
| 4,209,875 | 7/1980 | Pugh et al. | 15/344 |
| 4,238,869 | 12/1980 | Lachance | 15/353 |
| 4,463,474 | 8/1984 | Jacobs | 15/353 |

FOREIGN PATENT DOCUMENTS

| | | | |
|---|---|---|---|
| 1147360 | 4/1963 | German Democratic Rep. | 15/344 |

*Primary Examiner*—Chris K. Moore
*Attorney, Agent, or Firm*—Charles E. Baxley

[57] ABSTRACT

A vacuum cleaner for use with both dry and wet operation is formed of a housing which encloses a blower and a motor for driving the blower, the cleaner further including a canister having a nozzle and a storage chamber beneath the nozzle, which canister is removably securable to the front end of the housing. An intake port for air under suction is provided at the front end of the housing, the port having a liquid-deflecting hood extending from an upper portion thereof into the chamber for deflecting any liquid exiting from a posterior port of the nozzle into the chamber. The intake port for the entry of the air under suction is formed within a partition which extends across the housing, the lower portion of the partition serving as a wall which extends upward from the bottom of the housing to the bottom of the intake port to retain liquid, separated from the air stream, within the chamber.

10 Claims, 9 Drawing Figures

WET-DRY VACUUM CLEANER

BACKGROUND OF THE INVENTION

This invention relates to portable vacuum cleaners and, more particularly, to a vacuum cleaner capable of operating both with air and liquid cleaners.

Vacuum cleaners are utilized in numerous situations ranging from relatively light duty, such as the removal of crumbs and dust from a flat surface, as well as for relatively heavy duty operation as in the withdrawal of foreign matter embedded in carpets and upholstery. It is apparent from the wide range of cleaning tasks that some cleaning is best accomplished by the use of air alone, while other cleaning is best accomplished with the use of water or other cleaning liquid which is to be drawn by suction into the vacuum cleaner.

It is recognized that the use of a liquid cleaning agent necessitates a more complex structure in the vacuum cleaner. Thus it is necessary to protect a fan motor from contamination by the liquid. Provision must also be made for extraction of the foreign matter and the liquid cleaner from the vacuum cleaner upon completion of the cleaning process. In addition, the foregoing must be accomplished while allowing for the intake and exhaust of the air stream which is driven by suction of the cleaner fan.

The foregoing constraints become more difficult to attain in the case of a portable vacuum cleaner, because, as is readily appreciated, a hand held cleaner may be placed in a variety of positions and orientations so that, unlike a stationery cleaner, reliance cannot be made solely on the use of gravity for direction of the liquid cleaning agent away from the motor. Also, it is realized that the use of the traditional vacuum-cleaner bag fabricated of cloth or paper would be contraindicated because any liquid entrapped therein would tend to leak out upon removal of the bag.

Thus a problem exists in that the desirable feature of portability in a vacuum cleaner is difficult to attain in a situation wherein the vacuum cleaner is to be used for both wet and dry cleaning applications.

SUMMARY OF THE INVENTION

The foregoing problem is overcome and other advantages are provided by a vacuum cleaner which employs an electrically driven blower wherein batteries are utilized to power the electric motor so that portable operation can be attained. In accordance with the invention, both the liquid cleaning agent and the dirt are drawn through the nozzle, in response to the vacuum, and are then deposited in a storage chamber. Both the chamber and the nozzle are formed in the unitary structure of a canister which is readily secured to and removed from a housing which contains the motor and the fan. Thereby, the liquid and the dirt can be readily disposed of by detaching the canister from the housing, and then simply pouring out the liquid and the dirt from the canister. The canister is fabricated, preferably, of a hard plastic material which may be washed so that the canister can be reused many times, thereby obviating the need for a cloth or paper bag.

A partial vacuum produced by the fan provides a suction passage through the nozzle into the chamber and then into the housing to the fan. At an interface between the canister and the housing, there is provided a structure for the deflection of the liquid away from an entry port of the housing while permitting the air to pass into the housing. The deflection structure comprises a flexible member at a posterior port of the nozzle, the flexible member closing the port except during the presence of suction forces when the member is flexed away from the posterior port so as to admit the fluids into the chamber. A filter is placed at the entrance to the housing to trap particulate matter and a hood covers the top of the filter and extends forward beneath the flexible member to aid in the deflection of the liquid and dirt towards the central portion of the storage chamber, and away from the entry port to the housing. Thereby, during use of the vacuum cleaner in a substantially horizontal position, substantially all of the liquid collects in the storage chamber.

In the event that the vacuum cleaner is oriented in a non-horizontal position, at an angle of inclination sufficient to bring a liquid up against the filter, then some liquid is drawn through the filter to the fan. However, behind the fan there is provided a baffle which protects the motor from the liquid, the housing being provided with vents forward of the baffle through which the air and any liquid contained therein is exhausted to the exterior of the vacuum cleaner. Thereby, the motor is protected from the liquid in the event of an excessive inclination of the vacuum cleaner.

BRIEF DESCRIPTION OF THE DRAWING

The foregoing aspects and other features of the invention are explained in the following description taken in connection with the accompanying drawings wherein.

DETAILED DESCRIPTION OF THE DRAWING

Figure 1:
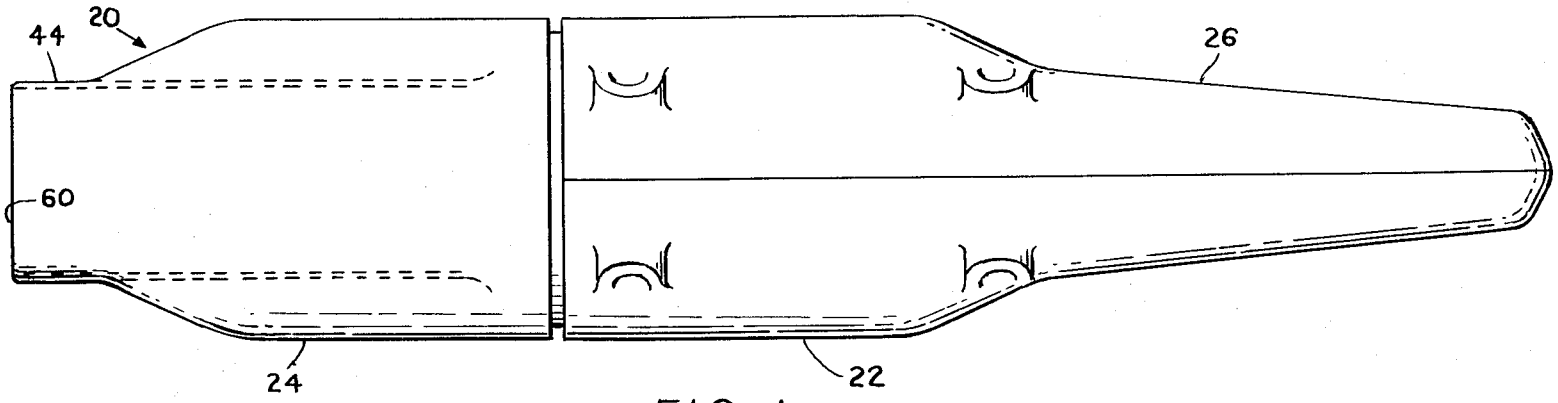
FIG. 1 is a top plan view of the vacuum cleaner of the invention.
Figure 2:
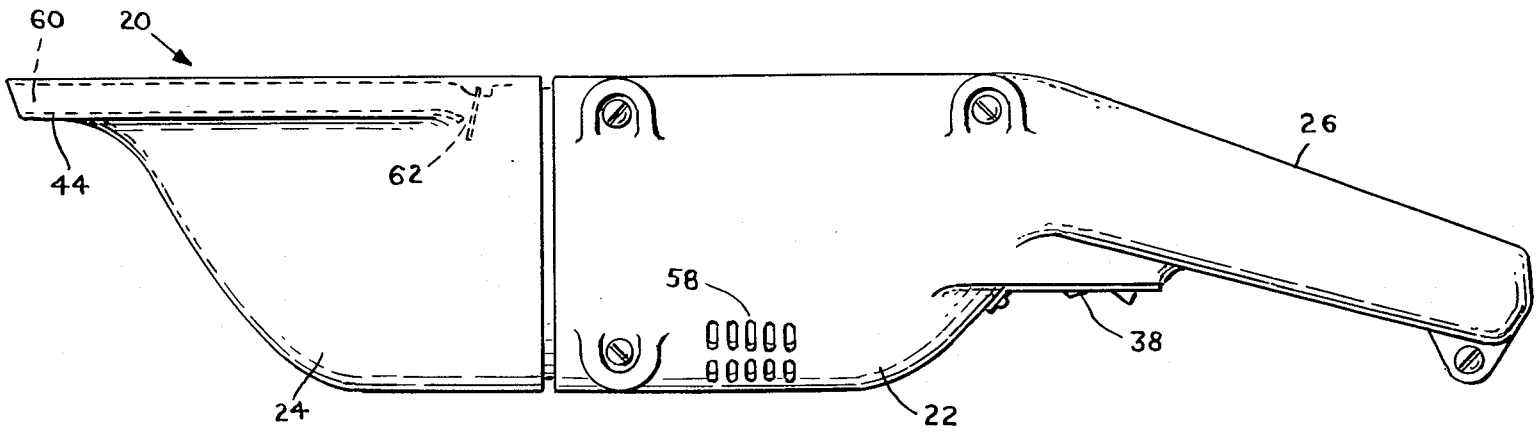
FIG. 2 is a side elevation view of the vacuum cleaner.
Figure 4:
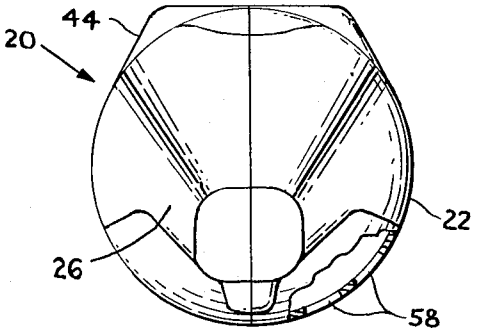
FIG. 4 is a back end view of the vacuum cleaner.
Figure 3:
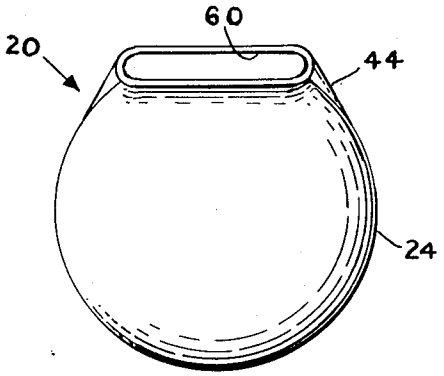
FIG. 3 is a front end view of the vacuum cleaner.
Figure 5:
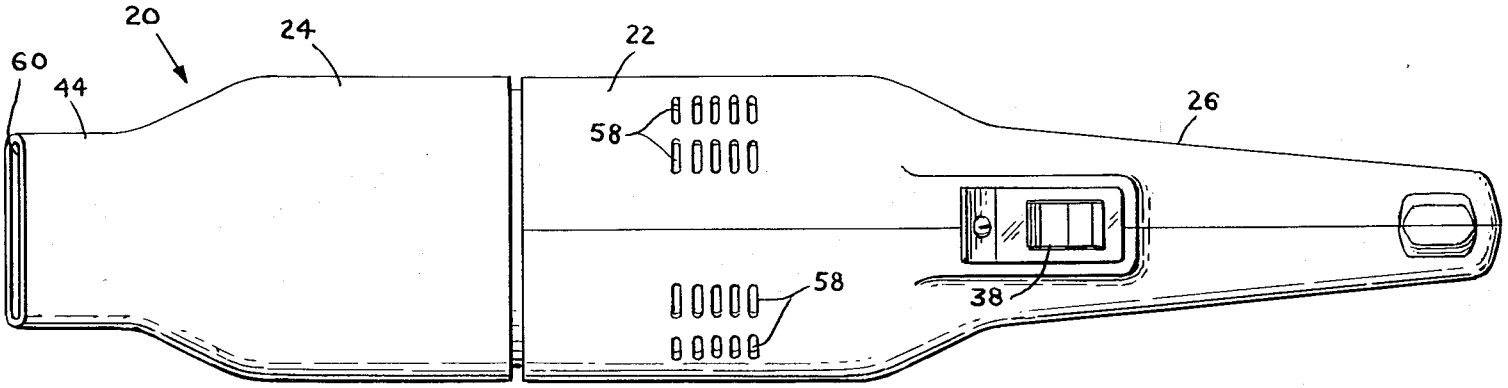
FIG. 5 is a bottom view of the vacuum cleaner.
Figure 6:
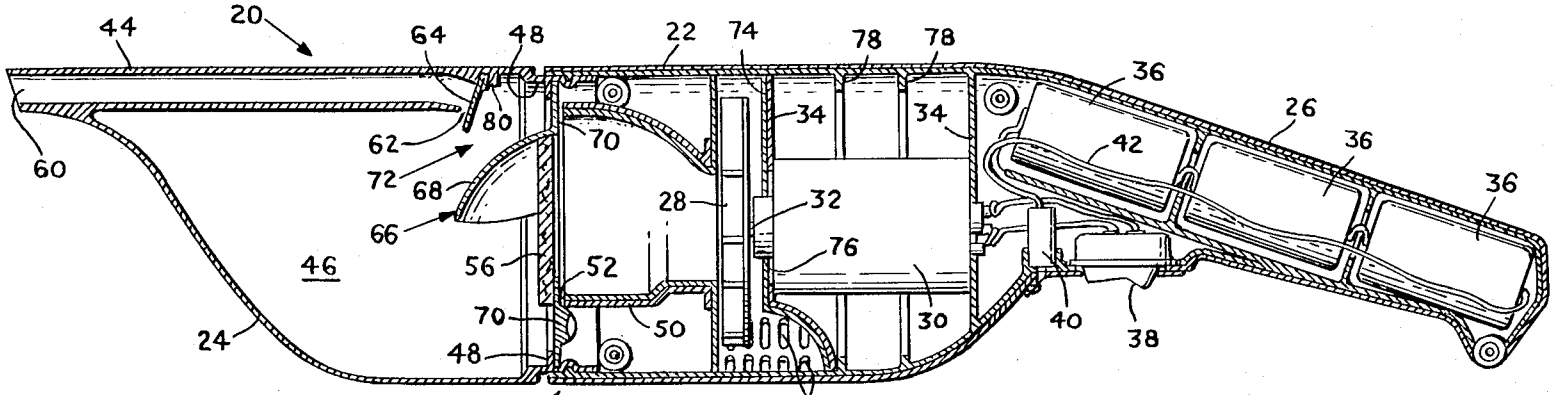
FIG. 6 is a sectional view of the vacuum cleaner taken along a longitudinal axial plane.
Figure 9:
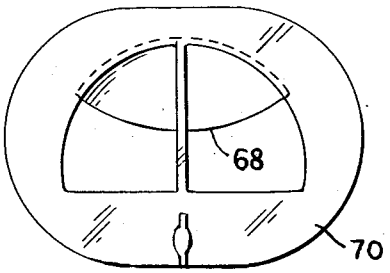
FIGS. 7, 8 and 9 are, respectively, a front view, a sectional view, and a back view of a hood assembly disclosed in FIG. 6, the view in FIG. 8 being seen along a central axial plane.
Figure 8:
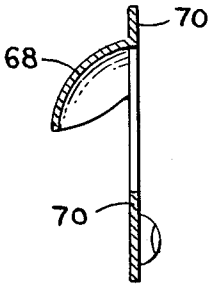
Figure 7:
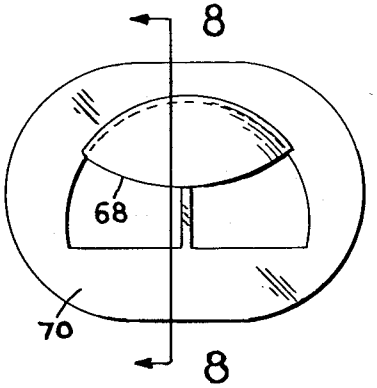

With reference to the FIGS. 1–9, there is shown a vacuum cleaner 20 incorporating the invention. The cleaner 20 comprises a central housing 22 having a canister 24 affixed to a front end thereof and a handle 26 extending from the back end thereof. The handle 26 is configured to be held in the hand of a person using the cleaner 20 for the cleaning of upholstery, rugs, as well as in the dusting of flat surfaces such as the top of a table.

The housing 22 contains a blower 28 which may also be referred to as a fan or impeller, and an electric motor 30 coupled by a shaft 32 to the blower 28. Rotation of the shaft 32 by the motor 30 imparts rotation to the blower 28 to create a partial vacuum and the accompanying suction which draws air through the canister 24 into the housing 22. The motor 30 is supported within the housing 22 by ribs 34 which are disposed circumferentially around the motor 30 and contact the interior surface of the housing 22. The motor 30 is powered by batteries 36. A switch 38 is positioned on the underside of the handle 26 for convenient engagement by means of the finger of a person utilizing the cleaner 20. Operation of the switch 38 provides for the coupling of electric power from the batteries 36 to the motor 30 for activation of the motor 30. A battery charger 40 may also be positioned within the handle 26 for recharging the batteries 36 during a period of nonuse of the cleaner 20, the charger being connected by a suitable electric cord (not shown) to an electrical convenience power outlet in the home or other location wherein the cleaner is to be used. Electric wiring 42 connects the batteries 36 by the switch 38 to the motor 30 and also connects the charger 40 to the batteries 36.

In accordance with a feature of the invention, the canister 24 incorporates a nozzle 44 and a storage chamber 46 disposed beneath the nozzle 44. The chamber 46 will be used for the collection of any liquid cleaning agents which may be drawn in by suction into the cleaner 20. The canister 24 is shown as being removably attached by means of a spring-clip assembly 48 to the forward end of the housing 22. Alternatively, the canister 24 can be made of a flexible plastic configured to spring-lock the canister into its operative position.

Within the housing 22, a conduit 50 having an entry port 52 conducts air under suction from the canister 24 to the blower 28. The entry port 52 is located at the region of an interface 54 between the housing 22 and the canister 24. An air filter 56 is located at the entry port 52 for the entrapment of particulate matter which may otherwise be drawn into the housing 22 by the passage of air towards the blower 28. Air drawn in by the blower 28 passes through the blower 28 and is then exhausted from the housing 22 via exhaust vents 58 disposed in the circumferential surface of the housing 22 and, more particularly, at the bottom portion of the housing 22 to permit the escape of any liquid which may have been drawn by the air stream through the filter 56 and the blower 28. Thus, in response to the suction generated by the blower 28, air enters the nozzle 44 at an anterior port 60 thereof, exits the nozzle 44 via a posterior port 62 thereof to enter the chamber 46, after which the air passes via the filter 56 into the conduit 50 and vents by the blower 28 to exhaust via the vents 58.

In accordance with the invention, the cleaner 20 includes a flapper valve 64 and a hood assembly 66, the latter including a hood 78 extending from a partition 70 downwardly over the upper portion of the filter 56. The flapper valve 64 and the hood 68, in cooperation with the positioning of the chamber 46 beneath the posterior port 62, constitute a deflection structure, indicated generally by the numeral 72, for deflecting liquid into the chamber 46 and away from the entry port 52, so as to accomplish a separation of the liquid from the air as both are drawn into the cleaner via the nozzle 44 under the force of the suction developed by the blower 28.

In operation, air, or both air and liquid may be drawn into the cleaner 20 depending on whether the cleaner 20 is used for dry operation or wet operation. While the cleaner 20 operates well in both situations, the invention is particularly useful in the case of the utilization of liquid cleaning agents, such as water or other solvents, along with the air which carries the liquid and dirt via the nozzle 44 into the chamber 46. By virtue of the deflection structure 72, the flapper valve 64 and the hood 68 direct liquid falling from the posterior port 62 upon the hood 68 towards the central portion of the chamber 46 and away from the entry port 52 of the conduit 50. Thus, with the cleaner 20 held in a subsantially horizontal position, or in a position wherein the canister 24 is pointing in a generally downward direction, liquid accumulates in the chamber 46 and rises against the lower portion of the partition 70 up to the bottom of the entry port 52. At this point, the chamber 46 should be regarded as sufficiently full to require emptying of the liquid before further cleaning is attempted. Accordingly, the canister 24 would then be detached from the housing 22 by means of the clip assembly 48 (or by deformation to overcome friction or by other suitable means) whereupon the stored liquid would be poured out of the canister 24.

In the event that the cleaning were continued without emptying of the canister 24, or in the event that the cleaner 20 were tipped upwards so that the canister 24 is raised above the housing 22, then some flow of liquid through the filter 56 would commence, the liquid then being drawn via the air stream along the conduit 50 and into the blades of the blower 28. However, even under this circumstance, the motor 30 is protected from the liquid by a baffle plate 74 in the exhaust vents 58. The baffle plate 74 extends across the housing 22 and engages with the outer surface of the front bearing 76 of the motor 30 for blocking the flow of liquid towards the motor 30 and directing such flow of liquid to the exhaust vents 58 at the bottom of the housing 22. Thereby, any liquid which fails to be caught within the chamber 46 exits the housing 22 via the vents 58.

In the manner of construction of the cleaner 20, the housing 22 has a generally cylindrical shape and includes ribs 78 for providing increased rigidity to the housing 22. The flapper valve 64 is formed of a flexible member, such as a membrane, which is anchored at its upper edge in a bossed extending inwardly from the wall of the nozzle 44. The hood 68 may be formed of metal or plastic, plastic being preferred for its resistance to corrosion. The hood 68 extends into the chamber 46 from the partition 70 so as to provide a suitable flow path for liquid entrained in the air stream. The force of the vacuum is sufficient to deflect the flexible member of the valve 64 so as to open the posterior port 62 for passage of the fluids.

In view of the accumulation of liquid and dirt, or dirt alone in the event that the cleaner 20 is utilized in the dry mode, within the storage chamber 46, and in view of the fact that the chamber 46 can be readily emptied and washed out, there is no need for the use of a fabric or paper bag for the entrapment of dirt as is frequently utilized in cleaning apparatus. Thus, the cleaner 20 can be utilized without the use of such bag, as is portrayed in FIG. 6.

It is to be understood that the above described embodiment of the invention is illustrative only and that modifications thereof may occur to those skilled in the art. Accordingly, this invention is not to be regarded as limited to the embodiment disclosed herein, but is to be limited only as defined by the appended claims.

I claim:

1. A vacuum cleaner comprising:

a motor;

a generally cylindrical housing having a front end and a back end, said housing enclosing said motor;

a blower driven by said motor and disposed ahead of said motor within said housing, rotation of said blower producing a vacuum;

a canister removably attached to the front end of said housing, said canister having an intake nozzle for receiption of dirt, liquid and air drawn into said nozzle in response to a vacuum developed by said blower;

said canister including a storage chamber disposed alongside said nozzle for the storage of matter drawn in via said nozzle, said canister being closed off at a front end thereof for holding said matter when said canister is in an erect position corresponding to a vertical orientation of the longitudinal axis of said nozzle;

deflection means disposed at an interface between said canister and said housing for deflecting liquid and dirt drawn in via said nozzle away from said housing and into said chamber;

said nozzle comprising a posterior port by which said nozzle communicates with said chamber, and said deflection means comprising a flexible closure member fully closing off said posterior port of said nozzle, said closure member being sufficiently flexible to deflect away from said posterior port under vacuum forces to open said posterior port, said closure member being oriented for direction of fluids transversely toward a central portion of said chamber; and wherein said closure member, upon a closing of said posterior port, secures said storage chamber against a spilling of liquid therefrom during erect and inclined orientations of said canister.

2. A vacuum cleaner according to claim 1 further comprising a filter disposed at said interface for trapping particulate matter being carried by an air stream from said canister toward said blower under the force of a vacuum.

3. A vacuum cleaner according to claim 2 wherein said deflection means further cmprises a hood disposed between said posterior port and said filter, said hood shielding said filter from a flow of matter drawn through said port by vacuum.

4. A vacuum cleaner according to claim 3 wherein said housing includes vents, alongside said motor, for exhausting air driven by said blower along with any dirt and liquid which, under suction of the vacuum, passes from said canister via said filter to said housing.

5. A vacuum cleaner according to claim 1 further comprising:

an air conduit connecting between said interface and said blower, an entry port of said conduit being configured for mating with an air filter; and wherein said deflection means further comprises:

a hood extending from the portion of said entry port of said conduit next to said posterior port into said chamber to a site away from said posterior port for deflecting dirt and liquid, drawn by vacuum, away from said conduit.

6. A vacuum cleaner according to claim 5 wherein said housing includes vents, alongside said motor, for exhausting air driven by said blower along with any dirt and liquid which, under suction of the vacuum passes from said canister via said conduit to said housing.

7. A vacuum cleaner according to claim 6 wherein at least a portion of said vents are located on a side of said housing, said cleaner including a filter disposed at the entry port of said conduit for trapping particulate matter being carried by an air stream from said canister toward said blower under the force of a vacuum.

8. In a vacuum cleaner operative with a source of suction, the improvement comprising:

a housing supporting the source of suction, said housing having an air intake port, and further comprising exhaust vents through which air, drawn in by the suction, is exhausted to the exterior of the housing;

a canister removably securable to said air intake port of said housing, said canister including a nozzle having an anterior port through which air exits the nozzle and a posterior port through which air exits the nozzle said canister further including a storage chamber positioned alongside said posterior port and communicating with said posterior port for reception of fluids including air and liquid cleaning agents which may be drawn in by the suction, said canister being closed off at a front end thereof for holding said matter when said canister is in an erect position corresponding to a vertical orientation of the longitudinal axis of said nozzle;

deflection means situated at an interface between said canister and said housing for deflecting the liquid into said storage chamber away from said intake port while permitting the flow of air under suction through said intake port into said housing, said deflection means comprising a flexible closure member fully closing off said posterior port of said nozzle, said closure member being sufficiently flexible to deflect away from said posterior port under vacuum forces to open said posterior port, said closure member being oriented for direction of fluids transversely toward a central portion of said chamber; and wherein said closure member, upon a closing of said posterior port, secures said storage chamber against a spilling of liquid therefrom during erect and inclined orientations of said canister.

9. A cleaner according to claim 1 wherein said deflection means includes a hood extending from a portion of said inftake port adjacent said posterior port to a site alongside said posterior port for the deflection of the liquid.

10. A cleaner according to claim 9 wherein said intake port is formed within a partition extending from a side of said housing to an edge of said intake port to block a passage of the liquid from said storage chamber into said housing.

* * * * *